US005408043A

United States Patent [19]

Lace

[11] Patent Number: 5,408,043

[45] Date of Patent: Apr. 18, 1995

[54] ELECTROMAGNETIC MUSICAL PICKUPS WITH CENTRAL PERMANENT MAGNETS

[75] Inventor: Melvin A. Lace, Prospect Heights, Ill.

[73] Assignee: Thomas E. Dorn, Clarendon Hills, ; a part interest

[21] Appl. No.: 998,734

[22] Filed: Dec. 30, 1992

Related U.S. Application Data

[63] Continuation-in-part of Ser. No. 764,346, Sep. 23, 1991, abandoned, and a continuation-in-part of Ser. No. 900,485, Jun. 18, 1992, each is a continuation-in-part of Ser. No. 597,899, Oct. 10, 1990, abandoned.

[51] Int. Cl.[6] ..... G10H 3/18

[52] U.S. Cl. ..... 84/726

[58] Field of Search ..... 84/723, 725, 726, 743, 84/727–729

[56] References Cited

U.S. PATENT DOCUMENTS

| | | |
|---|---|---|
| 2,089,171 | 6/1934 | Beauchamp . |
| 2,896,491 | 7/1959 | Lover . |
| 3,066,567 | 12/1962 | Kelley . |
| 3,183,296 | 5/1965 | Meissner . |
| 3,236,930 | 2/1966 | Fender . |
| 3,571,483 | 3/1971 | Davidson . |
| 3,588,311 | 6/1971 | Zoller . |
| 3,902,394 | 9/1975 | Stich . |
| 3,916,751 | 11/1975 | Stich . |
| 3,983,778 | 10/1976 | Bartolini . |
| 4,026,178 | 5/1977 | Fuller . |
| 4,133,243 | 1/1979 | DiMarzio . |
| 4,145,944 | 3/1979 | Helpinstill . |
| 4,220,069 | 9/1980 | Fender . |
| 4,268,771 | 5/1981 | Lace . |
| 4,320,681 | 3/1982 | Altilio . |
| 4,442,749 | 4/1984 | DiMarzio . |
| 4,501,185 | 2/1985 | Blucher . |
| 4,809,578 | 3/1989 | Lace . |
| 4,852,444 | 8/1989 | Hoover et al. . |
| 4,878,412 | 11/1989 | Resnik . |
| 5,072,646 | 12/1991 | Valkama . |
| 5,221,805 | 6/1993 | Lace ..... 84/726 |

*Primary Examiner*—William M. Shoop, Jr.
*Assistant Examiner*—Jeffrey W. Donels
*Attorney, Agent, or Firm*—Dorn, McEachran, Jambor & Keating

[57] ABSTRACT

An electromagnetic pickup for a musical instrument (e.g. a guitar) having a plurality of ferromagnetic strings coplanar and parallel with each other, the pickup being adapted to be mounted adjacent to but spaced from the strings includes an elongated electrical pickup coil having a longitudinal central opening, the opening having a length at least as great as the span S of the strings. The pickup also includes an elongated main permanent magnet having a length L such that L>S and an elongated ferromagnetic shell having a length at least as great as S. The main permanent magnet, the pickup coil, and the shell are assembled together in an electromagnetic pickup assembly in which at least one side of the pickup coil is enclosed by the shell, and the main permanent magnet is parallel to the central opening of the coil; the assembly generates a magnetic field which encompasses at least one portion of the pickup coil. A housing mounts the pickup assembly on the musical instrument with the top of the coil facing the instrument strings, which intercept a portion of the magnetic field.

12 Claims, 3 Drawing Sheets

ELECTROMAGNETIC MUSICAL PICKUPS WITH CENTRAL PERMANENT MAGNETS

This application is a continuation-in-part of prior applications Ser. No. 07/764,346 filed Sep. 23, 1991, abandoned and Ser. No. 07/900,485 filed Jun. 18, 1992, which are continuations-in-part of Ser. No. 07/597,899 filed Oct. 10, 1990, abandoned. Application Ser. Nos. 07/764,346 and 07/597,899 have been abandoned.

BACKGROUND OF THE INVENTION

For many years, electromagnetic signal pickups have been utilized on musical instruments having ferromagnetic strings. Such pickups have been employed with guitars, bass guitars, banjos, mandolins, and a variety of other instruments. A pickup for a musical instrument that uses ferromagnetic strings almost invariably incorporates a magnetic structure for generating a magnetic field that encompasses the strings. That magnetic structure usually includes at least one permanent magnet and at least one high-permeability pole piece. Frequently, the pickup has a separate pole piece or permanet magnet for each string; thus, a guitar pickup may have six pole pieces or six magnets, one for each string. On the other hand, some electromagnetic pickups have a single pole piece that spans a number of strings, often all of the strings of the instrument.

The pickup may have an electrical pickup coil for each string, or it may have one electrical pickup coil, spanning the poles for some or all strings, that generates a composite plural-string signal. The electrical signals from the coil or coils are amplified and reproduced by a speaker or other transducer as the output of the musical instrument. The electrical pickup coils are customarily disposed in encompassing relation to the magnetic cores; when there are plural coils each coil usually has its own core. This relatively simple electromagnetic structure is fitted into a housing. The housing may or may not be part of the magnetic structure. Whether or not it is a part of the magnetic structure, a principal purpose of the housing is to protect the pickup from dirt and other contaminants.

A wide variety of individual constructions have been used for electromagnetic pickups employed with musical instruments such as guitars. Frequently, the efforts of the pickup designer have been directed toward achieving an output signal from the electrical coil that is as close as possible to a faithful reproduction of the sound that would be developed by the instrument functioning as an acoustical device. This is not always the case, however; many electromagnetic pickups have been designed to give a particular distortion deemed desirable by the designer or by a musician.

For electromagnetic pickups in general, as applied to musical instruments having steel or other ferromagnetic strings, there may be some difficulty in obtaining an output signal of sufficient amplitude. This may be a minor problem, with modern electronic technology, because even a very weak signal can often be amplified to an adequate amplitude. On the other hand, a reasonable output amplitude from the pickup itself is desirable because it reduces the necessity for subsequent amplification, and thus reduces the likelihood of inadequately controlled distortion. Moreover, with adequate initial amplitude of the signal generated by the pickup, the signal-to-noise ratio is increased so that a "purer" signal can be realized.

A pronounced problem, in many electromagnetic pickups for musical instruments, has to do with the frequency response. The overall "sound" derived from the output signal is usually critical to the requirements of the musician. Some musicians want to have the output signal as close as possible to the acoustic output of the instrument, at least in theory. Others, however, want to have a distortion that is acceptable to them, one that represents their own concept or technique for interpretation of music. The frequency response characteristics of the pickup are critical in this regard. A similar situation is presented by the sound characteristic known to musicians as "sustain"; sometimes accented "sustain" is desirable in the view of the musician using the pickup and sometimes it is not.

Accordingly, the invention relates to an electromagnetic pickup for a musical instrument, such as a guitar, having a plurality of ferromagnetic strings disposed in substantially co-planar spaced relation to each other and extending parallel to each other in a given plane over a predetermined span S, the pickup being adapted to be mounted adjacent the strings in spaced relation thereto. The pickup comprises an elongated electrical pickup coil having two elongated portions on opposite sides of a longitudinal central opening, the opening having a length at least as great as S, and the coil having a predetermined height H. The pickup further comprises an elongated main permanent magnet, having a length L such that $L>S$, and an elongated ferromagnetic shell having a length at least as great as S and a height greater than H. The main permanent magnet, the pickup coil, and the shell are assembled together in an electromagnetic pickup assembly in which at least one elongated portion of the pickup coil is enclosed on three sides by the shell and the main permanent magnet extends parallel to the central opening of the coil; the assembly generates a magnetic field which encompasses at least the one portion of the pickup coil. Further, the pickup comprises mounting means, usually a housing, for mounting the pickup assembly on the musical instrument with the top of the coil facing but spaced from the strings of the instrument and with those strings intercepting a portion of the magnetic field.

SUMMARY OF THE INVENTION

It is a primary object of the invention, therefore, to provide a new and improved electromagnetic pickup, for a musical instrument having a plurality of ferromagnetic strings, which affords improved initial amplitude and signal-to-noise ratio, and that can generate signals having a broad range of different frequency and "sustain" characteristics.

A specific object of the invention is to provide a new and improved electromagnetic pickup for a plural ferromagnetic stringed musical instrument that affords a high amplitude output signal, despite substantial variations in the construction and operation of the pickup itself, and that can produce a variety of different frequency effects in its output signal.

Another object of the invention is to provide a new and improved electromagnetic pickup for a plural ferromagnetic stringed instrument, particularly a guitar, that is simple and inexpensive in construction, that can be readily mounted upon the guitar, and that has a virtually indefinite life.

DESCRIPTION OF THE PREFERRED EMBODIMENTS

Figure 1:
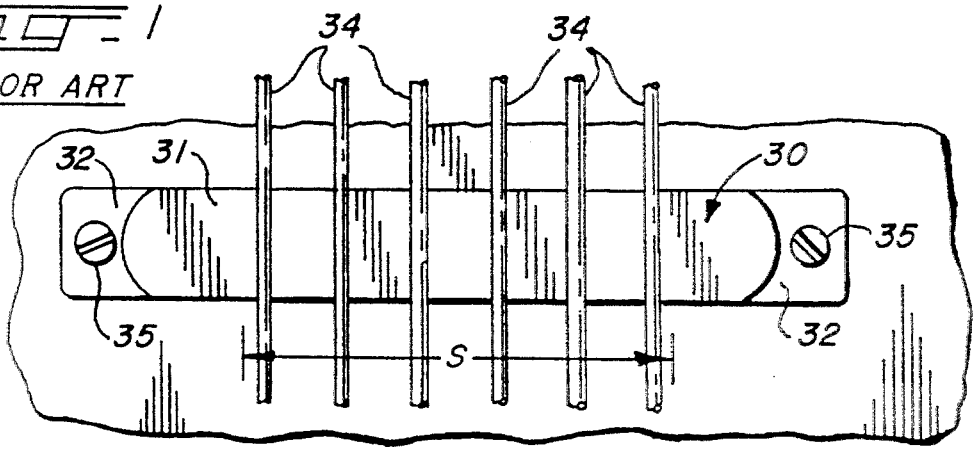
FIG. 1 PRIOR ART
FIG. 1 is a plan view of an electromagnetic musical pickup, specifically a guitar pickup, of the kind to which the invention is directed.
Figure 2:
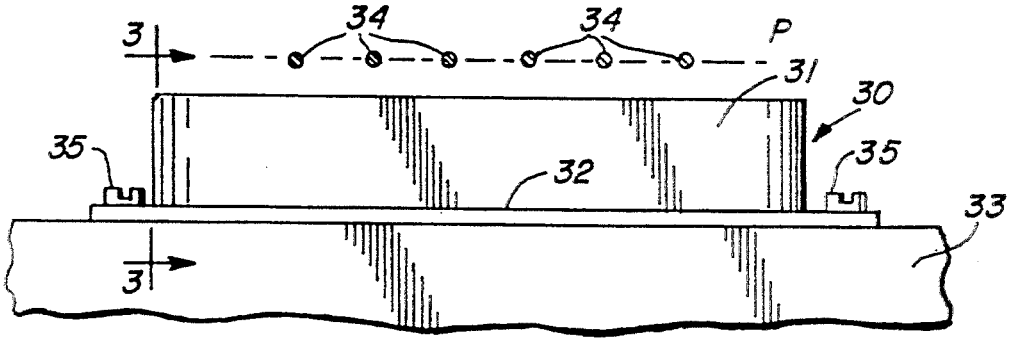
FIG. 2 PRIOR ART
FIG. 2 is a side elevation view of the pickup apparatus of FIG. 1.
Figure 3:
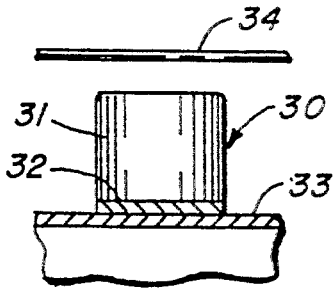
FIG. 3 PRIOR ART
FIG. 3 is a section view taken approximately along line 3—3 in FIG. 2.

FIGS. 1–3 illustrate an electromagnetic guitar pickup 30 that may be deemed generally representative of prior art pickups but that also applies to the electromagnetic musical pickups of the present invention. Typically, pickup 30 comprises a housing 31 that includes a base plate 32. Housing 31 may be formed entirely or partly of steel or other ferromagnetic material if it is used as an operating component of pickup 30; the housing may be of plastic if it is not a working magnetic component of the pickup. Pickup 30 is mounted on the top 33 of a musical instrument having a plurality of ferromagnetic strings 34. As illustrated, strings 34 are the six strings of a tenor guitar and extend across but in spaced relation to the top surface 33 of the guitar neck or body, depending upon where the pickup 30 is mounted. Strings 34 are distributed in a common plane P (FIG. 2) across a span S, FIG. 1, usually with approximately equal spacing between strings. Appropriate mounting devices 35 are utilized to mount pickup 30 on guitar body 33.

A wide variety of different electromagnetic sensing devices have been utilized in prior art embodiments of pickup 30; consequently, no specific pickup operating structure is shown in FIGS. 1–3. On the other hand, it may be noted that any known construction for electromagnetic pickup 30 would include a magnetic structure for generating a magnetic field that encompasses in part, the ferromagnetic strings 34. A structure of this sort, in the known prior art devices, may include at least one permanent magnet and may include at least one high permeability ferromagnetic pole piece. For the electromagnetic pickup 30 shown in FIGS. 1–3, utilizing known constructions, there could be six permanent magnets or six pole pieces, one for each string 34. On the other hand, some forms of electromagnetic pickup have utilized a single pole piece that extends the length of the pickup, beneath all of the musical strings 34.

In any of the known forms of electromagnetic pickup there is at least one electrical pickup coil, not shown in FIGS. 1-3; there may be separate coils for each of the strings 34, usually with all of those coils electrically connected together. The entire pickup construction, including the pole piece or pieces, the permanent magnet or magnets, and the electrical pickup coil or coils, is disposed in housing 31. Vibrations of the musical instrument strings 34, both vertically and horizontally, generate electrical signals in the coil or coils within housing 31, and it is those signals that are amplified and reproduced, as by one or more speakers, to afford an output from the musical instrument in conventional manner.

Figure 4:
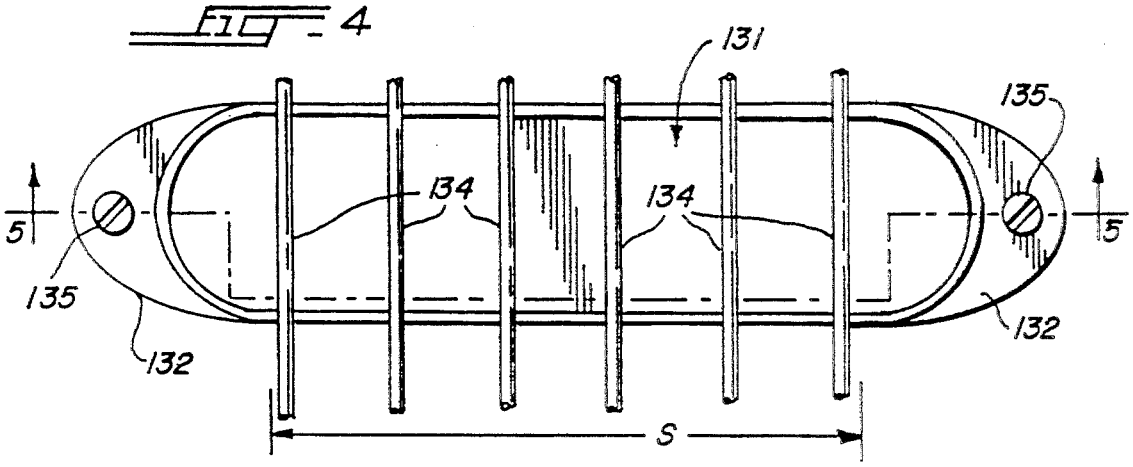
FIG. 4 is a plan view of the housing for a pickup comprising one embodiment of the invention, with the top of the housing omitted.
Figure 5:
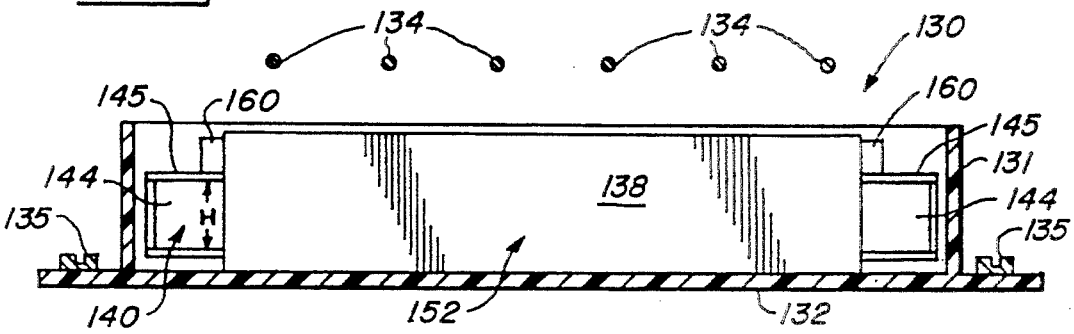
FIG. 5 is a longitudinal sectional view taken approximately along line 5—5 in FIG. 4, with the operating components of the pickup in place.

FIGS. 4–7 illustrate the housing and the electromagnetic operating components of a musical pickup 130 constructed in accordance with one embodiment of the present invention. Pickup 130 has a housing 131 with a base 132, as shown in FIGS. 4 and 5. The pickup includes an elongated electrical pickup coil 140 having two elongated side portions 141 and 142 on the opposite sides of a longitudinal central opening 143. Opening 143 has a length at least as great as S, the span of the ferromagnetic strings 134 of the instrument with which pickup 130 is to be used. At the ends of the pickup coil 140 includes two C-shaped connector portions 144 (FIGS. 5 & 6); the electrical coil is continuous around its central opening 143. Coil 140 has a height H; see FIGS. 5 and 7.

Figure 7:
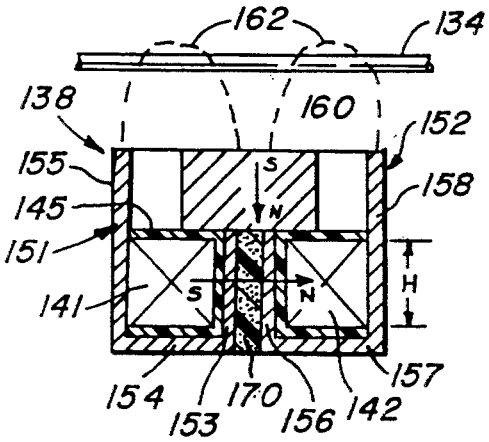
FIG. 7 is a transverse sectional view taken approximately along line 7—7 in FIG. 6.

Pickup 130 further comprises an elongated ferromagnetic shell having a length L at least as great as S, preferably longer than S, and a height greater than H. In the embodiment of FIGS. 4–7 the shell includes two J-shaped steel members 151 and 152, each preferably formed from ferromagnetic steel having a thickness of approximately 0.04 inch (0.1 cm). As shown in FIG. 7, the first shell member 151 includes a short vertical inner leg 153 joined to a bottom portion 154 in turn integral with an outer vertical leg 155 that is appreciably taller and that forms the outer leg of shell member 151. Similarly, the other shell member 152 includes a short inner leg 156, a bottom 157, and a tall outer leg 158. The upper edges of each of the shell legs 151, 153, 156 and 158 faces toward the instrument strings 134, as shown in FIG. 7. The two side portions 141 and 142 of the pickup coil are disposed within a continuous coil form 145.

Figure 6:
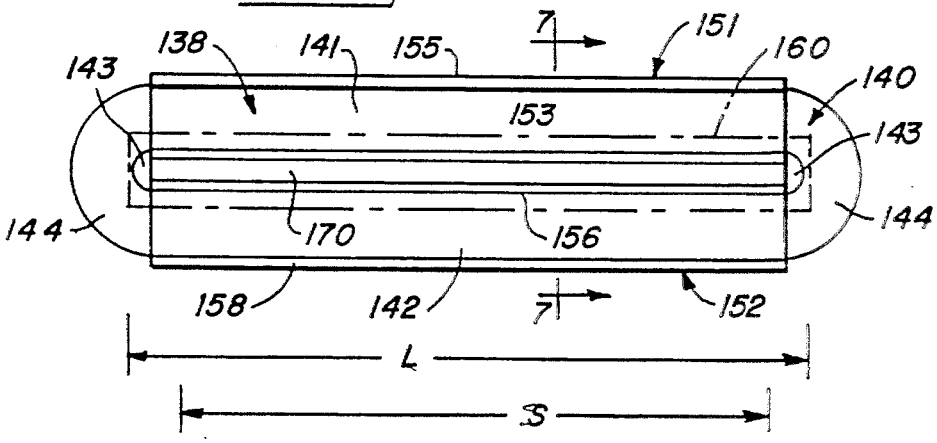
FIG. 6 is a plan view of a pickup assembly comprising the electromagnetic operating components for the pickup of FIG. 5.

Pickup 130, FIGS. 4–7, also includes an elongated main permanent magnet 160 that i$ shown in phantom outline in FIG. 6 and appears in solid lines in FIGS. 5 and 7. The main permanent magnet 160 has a length L, such that $L > S$. Permanent magnet 160 may comprise a ceramic permanent magnet, an Alnico permanent magnet, or other permanent magnet material as shown in FIG. 7, the main permanent magnet 160 is vertically magnetized so that the upper surface, the surface facing the strings 134, is of one polarity, and its bottom surface, facing coil 140, is of the opposite polarity. In the illustrated construction the upper surface of the main permanent magnet 160 is a south pole and the lower surface is a north pole; however, this polarization relationship can be reversed without changing the operation of pickup 130.

The electrical pickup coil 140, the elongated ferromagnetic shell comprising members 151 and 152, and the main permanent magnet 160 are all assembled together in an electromagnetic pickup assembly 138 shown in FIGS. 5–7. In assembly 138, pickup coil 140 is disposed entirely within the confines of the two shell members 151 and 152; that is, each of the two elongated side portions 141 and 142 and the bottom of the pickup coil are all completely enclosed by the ferromagnetic shell comprising members 151 and 152. The main permanent magnet 160 extends parallel to the central opening 143 of coil 140 and overlaps the tops of coil portions 141 and 142; see FIGS. 5–7. The overall arrangement is such that the magnetic field generated by assembly 138, indicated by dash lines 162 in FIG. 7, encompasses both of the elongated side portions 141 and 142 of pickup coil 140. When assembly 138 is inserted in housing 131, as shown in FIG. 5, the top of coil 140 faces toward but is spaced from the instrument strings 134 (see FIG. 7) and the ferromagnetic strings of the instrument intercept a portion of the magnetic field. As in the prior art arrangement, described above for FIGS. 1–3, suitable fastening means 135 may be provided to mount housing 131, and hence pickup 130, on a musical instrument in the desired operating position for pickup 130 relative to strings 134. Thus, housing 131 and its base 132 afford a means for mounting the pickup on the musical instrument in its desired position of operation.

The electromagnetic musical instrument pickup 130 of FIGS. 4–7 further comprises a thin, elongated secondary permanent magnet 170 that is interposed between the two shorter legs 153 and 156 of the two shell members 151 and 152 as best shown in FIGS. 6 and 7. The preferred permanent magnet material for this secondary permanent magnet 170 comprises a resin matrix of permanent magnet particles. A relatively flexible and slightly elastomeric resin that is impregnated with particulate permanent magnet material is preferred. Such permanent magnet materials are readily available commercially, especially in rather thin sheets. One acceptable form of flexible permanent magnet resin material for the secondary permanent magnet 170 is made and sold by 3M Company under the trademark PLASTIFORM; another flexible resin permanent magnet material that may be utilized in device 130 for the secondary permanent magnet 170 is made and sold by B. F. Goodrich Company under the trademark KOROSEAL. Yet another such permanent magnet resin material is available from The Electrodyne Company of Batavia, Ohio under the designation PLASTALLOY. The secondary permanent magnet 170 is magnetized transversely, as indicated in FIG. 7, the direction of magnetization being transverse to the legs of the two J-shaped shell members 151 and 152 and parallel to the plane of the instrument strings 134.

The pickup 130 of FIGS. 4–7 would appear to be somewhat inefficient magnetically because, with the polarizations shown, the secondary permanent magnet 170 interposed between the shorter legs 153 and 156 of the two ferromagnetic shell members 151 and 152 minimizes the effect of the main permanent magnet 160 on one side portion 142 of the electrical pickup coil 140. Actually, although this provides some imbalance in the generation of electrical signals in coil 140, the pickup is quite efficient. It produces a rather high amplitude output signal, usually three to four times the amplitude obtainable with previously known pickups, particularly guitar pickups. Moreover, despite the fact that there is but one coil 140 in the pickup, it exhibits excellent characteristics with respect to rejection of hum, in part due to the presence of the shell 151,152 encompassing the entire coil 140 and in part due to the presence of the auxiliary or secondary permanent magnet 170. That is, pickup 130 has an excellent signal-to-noise ratio. Stated differently, some hum from external 60 Hz fields and the like may be present, but it is so low that the output signal from coil 140 contains so little hum as to be virtually unnoticeable. There is little or no hum distortion.

All of the materials employed in pickup 130 are readily available on a commercial basis. Coil 140 is usually wound to a predetermined specification, which may vary in accordance with the desires or requirements of the pickup manufacturer. The preferred wire size for the coil is 44 gauge or larger. The dimensions of shell members 151 and 152 should be established to fit the coil and to extend high enough, at the outside of assembly 138, to cover the sides of the main permanent magnet 160. Typically, the two shell members 151 and 152, in a guitar pickup, may have a length of about 2.1 inches (5.3 cm), a height of approximately 0.5 inch (1.3 cm) and a thickness of the order of 0.05 inch (0.13 cm). In the illustrated construction, the overall height of permanent magnet 160 is about 0.2 inch (0.5 cm), a thickness readily available with a ceramic or even a metal (alnico) permanent magnet.

Figure 7A:
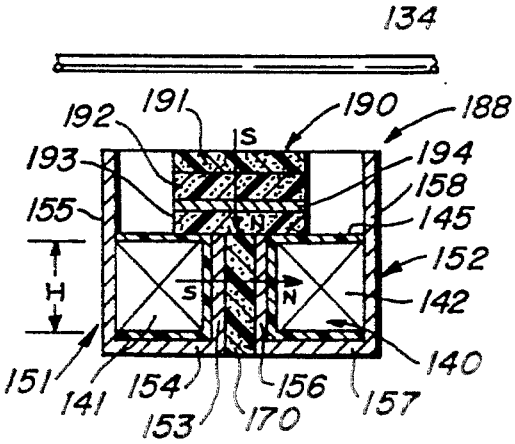
FIG. 7A is a transverse sectional view, like FIG. 7, of a modification of the invention.

FIG. 7A illustrates another electromagnetic pickup assembly 188 that is essentially similar to the previously described assembly 138 of FIG. 7 except for the main permanent magnet 190 utilized therein. Thus, in assembly 188 there are two essentially J-shaped ferromagnetic (steel) shell members 151 and 152 having adjacent shorter inner legs 153 and 156, bottom members 154 and 157, and longer outer legs 155 and 158, just as in the previously described embodiment. An auxiliary permanent magnet 170 is positioned between the two shorter legs 153 and 156 of the shell and is transversely magnetized as shown in FIG. 7A. The electrical pickup coil 140, in its supporting coil form 145, is disposed in encompassing relation to the two shorter legs 153 and 156 of the shell, with one elongated side 141 of the coil in shell 151 and the other elongated leg 142 of the coil in the bottom of the other shell 152. The position of assembly 188 in relation to the guitar strings 134 remains unchanged.

In the embodiment of FIG. 7A, however, assembly 188, the main permanent magnet 190 includes a plurality of elongated layers 191, 192 and 193 of permanent magnet material. These three layers 191–193 are of matched configurations and are stacked in the direction of magnetization which, as indicated in FIG. 7A, is perpendicular to the plane of strings 134. Each of these permanent magnet layers 191–193 may be formed of a resin matrix of particulate permanent magnet material such as those referred to above. Another material which may be used is a high energy product resin matrix available from The Electrodyne Company under the designation REANCE 90. The thickness of each of these three layers may be approximately 0.06 inch (0.15 cm), a common commercial thickness.

In the construction shown in FIG. 7A, for assembly 188, the main permanent magnet 190 also includes an elongated, thin, ferromagnetic member 194. Member 194 is preferably a strip of steel having a thickness of about 0.015 to 0.02 inch. This ferromagnetic member can be omitted, but has been found to be desirable with respect to overall performance of the electromagnetic pickup assembly 188. The location of the ferromagnetic layer 194 in the stack comprising the main permanent magnet 190 is somewhat arbitrary; the steel member may be interposed between layers 191 and 192, instead of in the position shown, with some minor modification of the overall characteristics of the pickup. In general, the overall performance of the construction shown in FIG. 7A is quite similar to that of FIG. 7; manufacturing costs may be somewhat lower because the resin-impregnated permanent magnet material is less expensive than a ceramic or a metallic permanent magnet and magnetization is easier. In either of the assemblies 138 of FIG. 7 and 188 of FIG. 7A, an additional shield magnet may be incorporated in the top of the assembly as described hereinafter in connection with FIG. 9.

Figure 8:
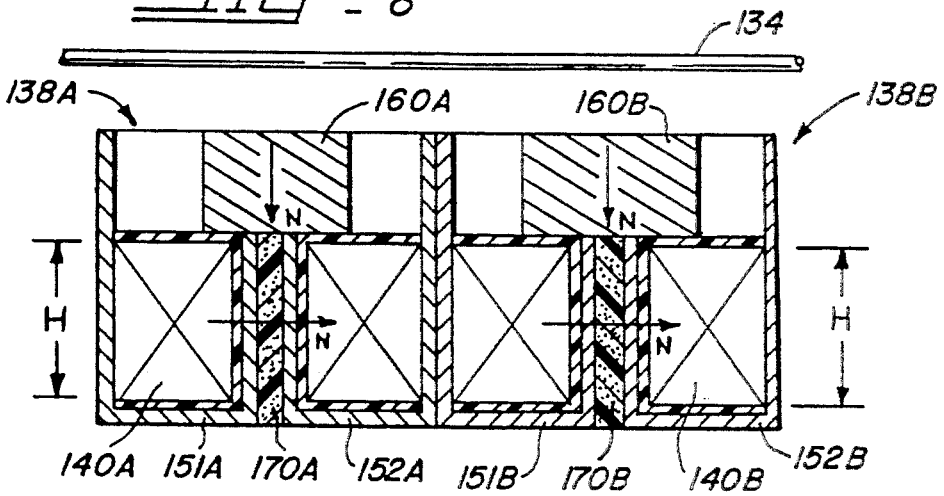
FIGS. 8, 9 and 10 are transverse sectional views, each like FIG. 7, of different pickups comprising further embodiments of the invention.

The transverse section view of FIG. 8 illustrates two electromagnetic pickup assemblies 130A and 130B having the same construction as shown in FIG. 7 but arranged side-by-side to form a two coil pickup that may be operated either as a humbucker pickup or as a dual pickup. At the left hand side of the pickup as shown in FIG. 8, there is an electromagnetic assembly 138A that includes a first electrical pickup coil 140A disposed in encompassing relation to the shorter vertical legs of two J-shaped ferromagnetic (steel) shell members 151A and 152A. A main permanent magnet 160A is positioned above coil 140A, on top of the shorter legs of the two shell members 151A and 152A. A secondary permanent magnet 170A is disposed intermediate the shorter legs of the two shell members. This construction is repeated in the other assembly 138B, which includes two J-shaped seal shell members 151B and 152B in which a pickup coil 140B is mounted. Again, there is a main permanent magnet 160B overlapping the two shorter legs of the steel shell members and a portion of the top of each side portion of coil 140B. A secondary permanent magnet 170B is disposed between the shorter legs of the two shell members 151B and 152B. The two permanent magnets 160A and 160B are each magnetized in a direction perpendicular to the plane of the instrument strings 134 and the two secondary or shield permanent magnets 170A and 170B are each magnetized in a horizontal direction as indicated in FIG. 8.

With the electrical coils 140A and 140B of the pickup shown in FIG. 8 operating in a conventional humbucker configuration, an output signal representative of movements of the strings 134 is obtained. That signal has a relatively high amplitude and is free of any hum or other external perturbations. Moreover, the pickup assembly is protected against vibrational feedback and microphonic effects. Thus, there is no "squeal" in the output signal, as may occur in some other pickups.

Figure 9:
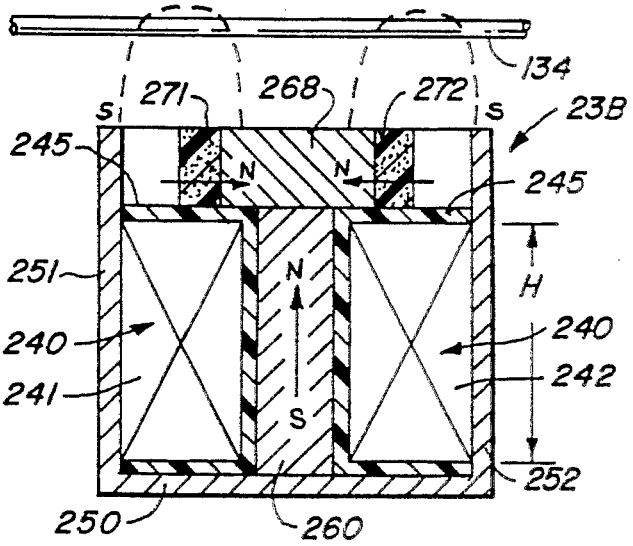

The transverse sectional view of FIG. 9 illustrates another embodiment of the present invention. In this instance the pickup assembly 238 comprises a one-piece ferromagnetic shell 250 that encompasses an electrical pickup coil 240 including two elongated coil portions 241 and 242. Shell 250 is of U-shaped configuration. The main permanent magnet 260 for assembly 230 is located at the center of the pickup, between the two halves of the coil form 245 for pickup coil 240. The main permanent magnet 260 is magnetized in a vertical direction, perpendicular to the plane of the instrument strings 134. This main permanent magnet 260 may comprise a single block of permanent magnet material, such as a ceramic permanent magnet or an Alnico magnet, as illustrated. On the other hand, the main permanent magnet 260 may comprise a stack of layers of permanent magnet material, much like the stack affording the main permanent magnet 190 of FIG. 7A.

The electromagnetic pickup assembly 238 of FIG. 9 includes a ferromagnetic core 268 that extends across the upper surface of the main permanent magnet 260 and overlaps both sides 241 and 242 of electrical pickup coil 240. Core 268, which may comprise a small steel bar, is flanked by two secondary or auxiliary permanent magnets 271 and 272 that are transversely magnetized. In the construction illustrated in FIG. 9 the direction of magnetization for each of these two secondary permanent magnets 271 and 272 is parallel to the plane of the instrument strings 134 and is such that the polarity of the secondary permanent magnets facing core 268 is the same as the polarity of the top surface of the main permanent magnet 260. It will be recognized that the polarizations illustrated in FIG. 9 can all be reversed without materially changing the performance of the pickup.

Pickup assembly 238 should be provided with a mounting means such as a housing (not shown); that housing may be like the previously described housing 131, 132 of FIGS. 4 and 5. This embodiment of the invention again affords a high amplitude output signal from coil 240. In the output signal from coil 240, there is little or no hum. In other respects, the performance is generally similar to the constructions described above in connection with FIGS. 7 and 7A. Of course, the overall length of the pickup must again be large enough to span all of the instrument strings 134 from which an output signal is to be derived. That is, the configuration of the pickup remains essentially as described above in connection with FIGS. 4–7. The two secondary or shield permanent magnets 271 and 272 need not be located in contact with core 268, as shown. Rather, they may be displaced from the core and may even be positioned in contact with the longer outer legs 251 and 252 of shell 250; if that is done, the heights of the shield magnets 271 and 272 may be increased so that they extend down alongside coil 240.

Figure 10:
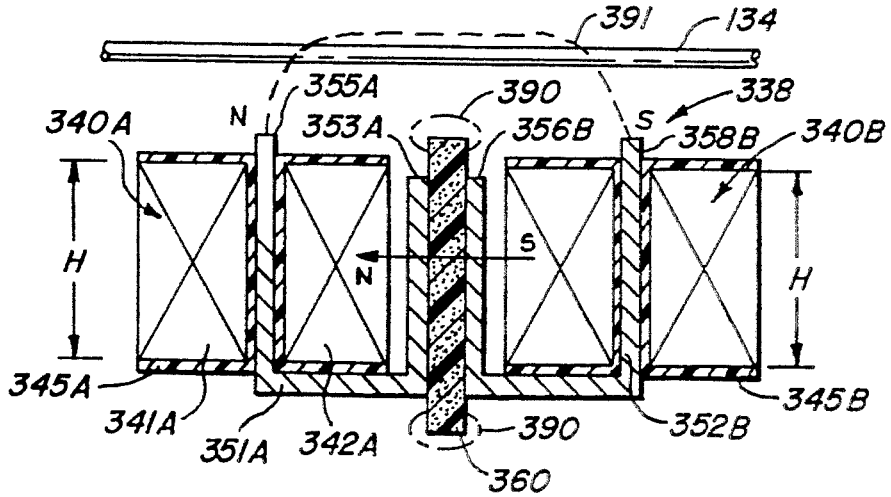

FIG. 10 illustrates another embodiment of the invention which, rather surprisingly, is highly efficient and exhibits virtually zero hum in its electrical output signal. The electromagnetic assembly 338 illustrated in FIG. 10 includes two elongated electrical pickup coils 340A and 340B. Coil 340A has two elongated side portions 341A and 342A and is disposed in encompassing relation to the longer outer leg 355A of a first J-shaped ferromagnetic shell member 351A. Coil 340B is similarly disposed in encompassing relation to the longer outer leg 358B of another J-shaped ferromagnetic shell member 352B. A main permanent magnet 360 is disposed between and in contact with the central shorter legs 353A and 356B of the two shell members. Permanent magnet 360 is transversely magnetized, in a direction parallel to the plane of the instrument strings 134. As shown, the main permanent magnet 360 provides a continuous north pole engaging the shorter leg 353A of shell member 351A and a continuous south pole in contact with the shorter leg 356B of shell member 352B. However, this polarization can be reversed with little or no change in overall operation of the device.

The main permanent magnet 360 of assembly 338, FIG. 10, however, projects beyond the shell legs 353A and 356B both at the top and at the bottom of the shell legs. This is done so that the magnetic flux 390 at the top and at the bottom of the main permanent magnet does not travel a short path directly between the oppositely polarized portions of the shell members in assembly 338. These short extensions of permanent magnet 360 above and below shell legs 353A and 356B, which may be as small as 0.02 inch, have a substantial effect on performance of a pickup constructed with the assembly 338, materially increasing the amplitude of the output signal from the pickup. The main operational flux for the electromagnetic pickup assembly 338, illustrated by the dash line 391, again is intersected by the strings 134 of the instrument, in the same manner as for all of the previously described embodiments of the invention.

A pickup constructed with the electromagnetic assembly 338 of FIG. 10, despite the fact that it requires only the one main permanent magnet 360, affords a very high amplitude output with virtually zero hum in the output signal. When the two electrical coils 340A and 340B are in a conventional humbucker configuration, as shown, the pickup affords a high amplitude output signal. Moreover, there is little or no vibrational feedback or microphonic effects. Assembly 338 (and assembly 239) is characterized by the absence of magnetic flux from the main permanent magnet in a direction perpendicular to the narrow central openings of the coils. As a consequence, there is no vibrational feedback.

For all embodiments of the invention the parameters of individual components are essentially similar. Permanent magnet materials of relatively low energy product can be utilized; in some embodiments, higher energy magnets (e.g., ceramic magnets or Alnico magnets) can be employed but they do add to the cost. In any embodiment of the invention the steel shell may be fabricated from No. 1008 steel, usually in a thickness range of 0.015 to 0.05 inch (0.05–0.13 cm). The coils should be wound with No. 44 gauge conductive wire or larger. The use of relatively large wire in the coils reduces coil capacitance, with attendant advantages in overall operation.

I claim:

1. An electromagnetic pickup for a musical instrument, such as a guitar, having a plurality of ferromagnetic strings disposed in spaced relation to each other and extending parallel to each other over a predetermined span S, the pickup being adapted to be mounted adjacent the strings in spaced relation thereto, the pickup comprising:

an elongated electrical pickup coil having two elongated portions on opposite sides of a longitudinal central opening, the opening having a length at least as great as S, and the coil having a predetermined height H;

an elongated main permanent magnet having a length L such that $L>S$;

and an elongated ferromagnetic shell having a length at least as great as S and a height greater than H;

the ferromagnetic shell including two elongated shell members of J-shaped cross-sectional configuration, each shell member having a base, a long leg projecting normal to the base from one edge of the base, and a short leg projecting normal to the base from the opposite edge of the base, the shell members being disposed with the short leg of each shell member facing the short leg of the other at the center of the assembly and with the short leg of each shell member having an upper edge facing toward the instrument strings; and the main permanent magnet, the pickup coil, and the shell being assembled together in an electromagnetic pickup assembly with the pickup coil disposed in encompassing relation to the two short legs of the shell members, in which assembly:

at least one elongated portion of the pickup coil is enclosed on three sides by the shell;

the main permanent magnet extends parallel to the central opening of the coil; and the assembly generates a magnetic field which encompasses at least the one portion of the pickup coil;

and mounting means for mounting the pickup assembly on the musical instrument with the top of the coil facing but spaced from the strings of the instrument and with those strings intercepting a portion of the magnetic field.

2. An electromagnetic pickup for a plural ferromagnetic string musical instrument, according to claim 1 in which:

the main permanent magnet is aligned with and extends along the upper edges of the shorter legs of the two shell members; and the main permanent magnet is magnetized in a direction perpendicular to the instrument strings and perpendicular to the bottoms of the two shell members.

3. An electromagnetic pickup for a plural ferromagnetic string musical instrument, according to claim 2 and further comprising:

a thin, elongated secondary permanent magnet interposed between the shorter legs of the two shell members;

the secondary permanent magnet being magnetized transversely, in a direction transverse to the legs of the shell members and parallel to the instrument strings.

4. An electromagnetic pickup for a plural ferromagnetic string musical instrument, according to claim 2, in which:

the main permanent magnet includes a plurality of elongated layers, all of the same configuration and all made of permanent magnet material, stacked in the direction of magnetization for the main permanent magnet.

5. An electromagnetic pickup for a plural ferromagnetic string musical instrument, according to claim 4, and further comprising:

an elongated, thin, ferromagnetic member, having the same configuration as the main permanent magnet layers, interposed between two layers of the main permanent magnet.

6. An electromagnetic pickup for a musical instrument, such as a guitar, having a plurality of ferromagnetic strings disposed in spaced relation to each other and extending parallel to each other over a predetermined span S, the pickup being adapted to be mounted adjacent the strings in spaced relation thereto, the pickup comprising:

an elongated electrical pickup coil having two elongated portions on opposite sides of a longitudinal central opening, the opening having a length at least as great as S, and the coil having a predetermined height H;

an elongated main permanent magnet having a length L such that $L>S$;

and an elongated ferromagnetic shell having a length at least as great as S and a height greater than H;

the ferromagnetic shell includes two elongated J-shaped shell members of J-shaped cross-sectional configuration, each shell member having a base, a long leg projecting normal to the base from one edge of the base, and a short leg projecting normal to the base from the opposite edge of the base, the shell members being disposed with the short leg of each shell member facing the short leg of the other at the center of the assembly and with the short leg of each shell member having an upper edge facing toward the instrument strings;

the pickup further comprising a second elongated pickup coil, the two pickup coils having approximately the same size and configuration; and each of the two electrical pickup coils are disposed in encompassing relation to the long leg of a respective one of the shell members.

7. An electromagnetic pickup for a plural ferromagnetic string musical instrument, according to claim 6 in which:

the main permanent magnet is disposed between the two short legs of the two shell members; and the main permanent magnet is magnetized transversely to present a north pole facing the short leg of one shell member and a south pole facing the short leg of the other shell member.

8. An electromagnetic pickup for a plural ferromagnetic string musical instrument, according to claim 7 in which:

the main permanent magnet has a height greater than H and projects beyond the short legs of the shell members in at least one direction perpendicular to the plane of the strings.

9. An electromagnetic pickup for a plural ferromagnetic string musical instrument, according to claim 8 in which:

the main permanent magnet projects beyond the short legs of the shell members in two directions perpendicular to the strings.

10. An electromagnetic pickup for a musical instrument, such as a guitar, having a plurality of ferromagnetic strings disposed in spaced relation to each other and extending parallel to each other over a predetermined span S, the pickup being adapted to be mounted adjacent the strings in spaced relation thereto, the pickup comprising:

an elongated electrical pickup coil having two elongated portions on opposite sides of a longitudinal central opening, the opening having a length at least as great as S, and the coil having a predetermined height H;

an elongated main permanent magnet having a length L such that $L>S$;

and an elongated ferromagnetic shell having a length at least as great as S and a height greater than H;

the main permanent magnet, the pickup coil, and the shell being assembled together in an electromagnetic pickup assembly in which at least one elongated portion of the pickup coil is enclosed on three sides by the shell, the main permanent magnet is aligned with the central opening of the coil, and the assembly generates a magnetic field which encompasses at least the one portion of the pickup coil;

an elongated ferromagnetic core aligned with and extending along the top of the main permanent magnet, the core having a width sufficient to overlap a part of the coil at both sides of the central opening of the coil;

and mounting means for mounting the pickup assembly on the musical instrument with the top of the coil facing but spaced from the strings of the instrument and with those strings intercepting a portion of the magnetic field.

11. An electromagnetic pickup for a plural ferromagnetic string musical instrument, according to claim 10, and further comprising:

an elongated secondary permanent magnet disposed adjacent to the core and magnetized transversely to present a surface of given uniform magnetic polarity facing the core, that given polarity matching the magnetic polarity of the uppermost surface of the main permanent magnet.

12. An electromagnetic pickup for a musical instrument, such as a guitar, having a plurality of ferromagnetic strings disposed in spaced relation to each other and extending parallel to each other over a predetermined span S, the pickup being adapted to be mounted adjacent the strings in spaced relation thereto, the pickup comprising:

two elongated electrical pickup coils each having two elongated portions on opposite sides of a longitudinal central opening, each opening having a length at least as great as S, and each coil having a predetermined height H;

an elongated main permanent magnet having a length L such that $L>S$;

and an elongated ferromagnetic shell having a length at least as great as S and a height greater than H;

the main permanent magnet, the pickup coils, and the shell being assembled together in an electromagnetic pickup assembly in which at least one elongated portion of each pickup coil is enclosed on three sides by the shell, the main permanent magnet is aligned with the central opening of the coils and is magnetized in a direction parallel to the instrument strings, and the assembly generates a magnetic field which encompasses at least the one portion of each pickup coil;

and mounting means for mounting the pickup assembly on the musical instrument with the tops of the coils facing but spaced from the strings of the instrument and with those strings intercepting a portion of the magnetic field.

* * * * *